US006467279B1

(12) United States Patent
Backman et al.

(10) Patent No.: US 6,467,279 B1
(45) Date of Patent: Oct. 22, 2002

(54) LIQUID SECONDARY COOLING SYSTEM

(76) Inventors: Thomas J. Backman, 105 Core Dr., Morehead City, NC (US) 28557; James F. Roomsburg, 744 Rochelle Arch, Virginia Beach, VA (US) 23464

( * ) Notice: Subject to any disclaimer, the term of this patent is extended or adjusted under 35 U.S.C. 154(b) by 0 days.

(21) Appl. No.: 09/702,096

(22) Filed: Oct. 30, 2000

Related U.S. Application Data

(63) Continuation-in-part of application No. 09/316,836, filed on May 21, 1999, now Pat. No. 6,205,795.

(51) Int. Cl.[7] ..... F25B 7/00
(52) U.S. Cl. ..... 62/79; 62/113; 62/434
(58) Field of Search ..... 62/434, 79, 114, 62/113

(56) References Cited

U.S. PATENT DOCUMENTS 4,286,435 A * 9/1981 Cann et al. ..... 62/278
5,491,982 A * 2/1996 Gowans ..... 62/434
5,524,442 A * 6/1996 Bergman, Jr. ..... 62/434
5,784,893 A * 7/1998 Furuhama et al. ..... 62/434
6,067,814 A * 5/2000 Imeland ..... 62/434

* cited by examiner

*Primary Examiner*—Ronald Capossela
(74) *Attorney, Agent, or Firm*—Mills Law Firm PLLC

(57) ABSTRACT

A secondary loop refrigeration system includes plural refrigeration zones serially connected in a secondary cooling loop using a R-134*a* as a liquid refrigerant in increasing order of operating temperatures, the secondary cooling loop being in heat exchange relationship with a primary cooling loop using direct expansion refrigerants. The primary cooling loop may be selectively isolated allowing the latent heat of the units in the zones to increase the circulating temperature of the secondary refrigerant sufficient to defrost the cooling coils.

5 Claims, 4 Drawing Sheets

LIQUID SECONDARY COOLING SYSTEM

REFERENCE TO RELATED APPLICATIONS

This application is a continuation-in-part application of U.S. patent application Ser. No. 09/316,836 filed on May 21, 1999, now U.S. Pat. No. 6,205,795 in the name of Thomas J. Backman et al. and entitled "Series Secondary Cooling System".

FIELD OF THE INVENTION

The present invention relates to secondary loop refrigeration, and in particular, to a method and apparatus using as a secondary loop refrigerant, tetrafluoroethane also commonly known as R-134a.

BACKGROUND OF THE INVENTION

The cooling system for commercial and retail establishments generally comprise a remotely located primary unit that is individually connected to the various cooling loads or zones therein, such as air conditioning, low temperature freezer units, and mid-temperature refrigeration units. Such arrangements in a typical supermarket refrigeration system oftentimes require hundreds or thousands of pounds of refrigerant charge in addition to thousands of feet of refrigerant lines. Additionally, plural primary units may be employed, however, each conditioned area nonetheless requires individual connection.

The problems associated with the above approaches have been further complicated by changes in the permissibility and availability of direct expansion refrigerants commonly used for such systems. Certain chlorofluorocarbons and perfluoroalkanes are being phased out because of their environmental impact. To the extent obtainable, the cost of such refrigerants are increasing markedly making the cost of the installed system considerably more expensive. Certain non-chlorinated low temperature and medium temperature refrigerants have been developed as alternatives, however, they tend to be even more costly. Other high temperature direct expansion refrigerants, such as R-134a, are more moderate in cost, but are not effective in direct expansion cooling systems below air conditioning temperatures. At present, accordingly, R-134a finds application predominantly as a direct expansion refrigerant for motor vehicles air conditioning systems.

The foregoing problems have prompted refrigeration equipment manufacturers to propose the use of secondary liquid cooling. Therein, a primary condensing unit is closely coupled to a direct expansion heat exchanger. The refrigerant for the primary system may be selected based on performance, and because of the shorter supply lines the cost thereof is reduced. The direct expansion heat exchanger is coupled to a secondary system using a liquid secondary refrigerant. The secondary refrigerant is pumped through individual secondary lines to the liquid chilling coils in various temperature control zones, such a refrigerated displays, walk-in coolers and the like.

One such system is disclosed in U.S. Pat. No. 5,713,211 to Sherwood. Therein, a liquid secondary refrigerant is directed in a secondary cooling loop from a primary-secondary heat exchanger to a series of display cases and pumped back to the heat exchanger. Only a single zone, of the many zones typically found in commercial applications, is covered in the secondary loop. The secondary loop is not operative to provide coil defrosting.

Another approach is disclosed in U.S. Pat. No. 5,524,442 to Bergman et.al. wherein a secondary refrigeration loop employs an open loop air stream that directly impinges a product to be cooled. The secondary loop return air system is directed to a secondary heat exchanger interfaced with a primary refrigeration loop.

A plurality of secondary refrigeration loops using a single refrigerant are disclosed in U.S. Pat. Nos. 5,318,845 to Dorini et. al. and 5,138,845 to Mannion et. al. Therein, the return lines of the primary refrigeration are fed in parallel as the inlet lines to the secondary cooling loads and the secondary return lines are connected with the primary inlet lines. Control systems are provided with each cooling load to control temperature and flow rates. While providing some localization of lines, a single refrigerant charge for the cooling demands of the generally similar temperature demands of the various units of the system.

A further approach is disclosed in U.S. Pat. No. 5,042,262 to Gyger et. al. wherein second closed loop system is operative to transfer heat from a single heat sink using carbon dioxide as a secondary refrigerant.

It is apparent from the above that such secondary loop designs have not focused on the major problems associated with plural refrigerant systems, i.e. consolidation of the high cost/high performance primary refrigerant loop and a secondary loop capable of handling plural cooling zones of the type found in supermarkets, cold storage facilities, hospitals, industrial plants, hotels, shopping centers, and like locations requiring cooling, refrigeration and heating. By focusing on parallel exchanges, high fluid volume cost, high equipment costs, and power consumption for fluid transfer remain a problem.

SUMMARY OF INVENTION

The present invention addresses and overcomes the aforementioned problems and limitations by providing a secondary refrigeration system incorporating a continuous series of progressively increasing temperature zones in a single secondary cooling loop. Therein, R-134a. as a secondary fluid is interfaced with the primary system and has the fluid feed line connected in parallel to a plurality of cooling loads having the highest cooling demands, such as freezer units. The return lines of the first loads are combined and fed to a second zone of cooling loads having the next highest cooling demand, such as refrigerated displays. Thereafter the second zone return lines are fed back to the heat exchanger or to subsequent zones in a similar manner, such as air conditioning equipment.

Such design eliminates the need for individual piping for each zone thereby reducing refrigerant, equipment, power consumption and piping costs. Moreover, the heat exchanger may be bypassed for defrosting the coils in the zones wherein the temperature rise from the line loading will warm the coils sufficiently for defrosting, while upon completion of defrosting, the system may be quickly returned to operative status. Furthermore, the aforementioned design permits the use of low cost non-chlorinated fluids operative in the liquid phase providing the requisite viscosity, specific heat, thermal conductivity, and environmental acceptability while providing efficient heat transfer within temperatures ranging from −40° F. to +80° F.

Accordingly, it is an object of the present invention to provide a secondary cooling system having reduced material, equipment and operating costs in conditioning a plurality of cooling zones.

A further object of the invention is to provide a plurality of increasing temperature zones that are serially connected in a secondary cooling loop.

Another object of the invention is to provide secondary cooling loop system using environmentally acceptable high performance refrigerants in a liquid phase with chilling coils in a series connection of increasing temperature zones.

Yet another object of the invention is to provide a liquid secondary refrigeration loop connecting a plurality of cooling zones wherein the loop may be quickly and conveniently disabled allowing the latent heat from the units to raise the temperature of the fluid sufficiently for defrosting purposes.

DESCRIPTION OF DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
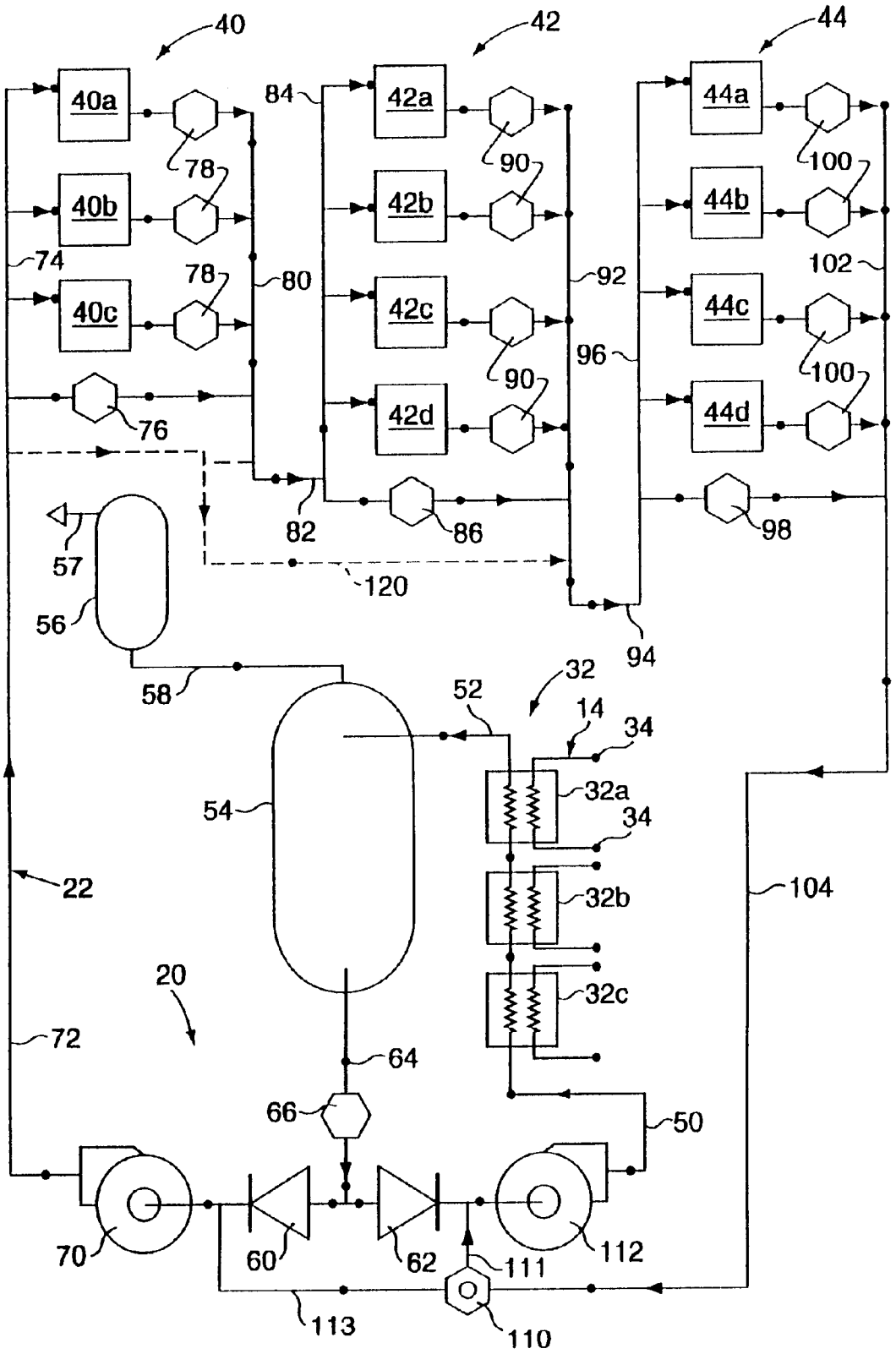
FIG. 1 is a schematic diagram of a serial banked secondary refrigeration system in accordance with the present invention.

Referring to the drawings for the purpose of describing a preferred embodiment of the present invention and not for limiting same, FIG. 1 shows a refrigeration system 10 for a facility having a plurality of cooling zones or loads to be maintained respectively at differing temperatures.

The system 10 includes a primary refrigeration system 12 for transferring heat in a primary loop 14 to an external environment using a primary refrigerant, and a secondary loop refrigeration system 20 for transferring heat from the cooling zones in a secondary loop 22 to the primary refrigeration system 12 using a secondary refrigerant. The system 10 is suitable for installation in a supermarket setting and will be described with reference thereto. However, it will become apparent that the system may be beneficially utilized in other multiple zone venues including without limitation cold storage facilities, hospitals, refrigerated industrial plants, hotels, shopping centers, laboratories, prisons, schools and industrial, institutional, commercial and residential spaces requiring temperature control at varying levels in multiple zones.

The primary refrigeration system 12 may be any suitable commercially available design comprising typically a remotely located compressor unit (not shown), located external of the facility and typically on the roof thereof, having inlet lines 30 communicating with a multiple stage direct-expansion evaporator 32 having stages 32*a*, 32*b* and 32*c*; and a return line 34 returning to the compressor unit. A suitable primary refrigerant for the primary loop would be R-22, R-404A or R-507. The evaporator 32 is preferably located proximate the compressor unit in order to minimize the length of the primary loop 12 and the primary refrigerant charge, but with convenient access to the cooling zones to be controlled.

As described below in greater detail, the secondary refrigeration system 20 is connected with cooling zones or loads including a low temperature units 40, such as freezers maintained in the operating range of about −40° F. to +9° F., medium temperature units 42 maintained in the operating range of about +10° F. to +38° F., and air conditioned units 44 maintained in the operating range of about +39° F. to +80° F. Plural units are illustrated for each zone, however, it will be appreciated that the number of units and zones will vary depending on the requirements of a particular facility.

The secondary refrigeration system includes an inlet line 50 leading to the evaporator 32, an exit line 52 leading from the evaporator 32 to a coolant reservoir 54. An expansion tank 56 having a pressure relief valve 57 is connected to the reservoir 54 by line 58. The reservoir 54 is connected with branched check valve 60, 62 through exit line 64 that includes a pressure regulator 66. Refrigerated fluid from the reservoir 54 flows past check valve 60 to a supply pump 70. The supply pump 70 is effective for maintaining flow and pressure conditions through the temperature zones and may be either a constant volume or constant pressure pump depending on the overall needs of the cooling system. At various locations as illustrated by the unnumbered solid circles, isolation valve may be provided for temporarily isolating discrete sections of the system.

The secondary refrigerant flows from the pump 70 through line 72 to a low temperature inlet manifold 74 having parallel inlet lines respectively communicating with freezer units 40*a*, 40*b*, 40*c*, and bypass valve 76. The outlet lines of the freezer units include temperature control valves 78 communicating in parallel with the exit line of valve 76 with a low temperature exhaust manifold 80. In a conventional manner, the valves 78 are individually effective to maintain desired temperature conditions in the units 40 in a well known manner. The bypass valve 76 may be stepped or continuous varied by appropriate controls to maintain volumetric flow conditions in the secondary loop 22 sufficient for the overall needs of the system 10. Additionally, the intake manifold 74 and the units 40 may include isolation valves, as illustrated, for removing the units from operation for service, replacement and the like.

The exhaust manifold 80 of the low temperature units 40 is connected by intermediate line 82 with a mid-temperature intake manifold 84 having inlets communicating with the mid-temperature units 42*a*, 42*b*, 42*c*, 42*d* and bypass valve 86. The outlet lines of the refrigerator units include temperature control valves 90 communicating in parallel with the exit line of valve 86 with a mid-temperature exhaust manifold 92. In a conventional manner, the valves 90 are individually effective to maintain desired temperature conditions in the refrigeration units 42 in a well-known manner. The bypass valve 86 may be stepped or continuous varied by appropriate controls to maintain volumetric flow conditions in the secondary loop 22 sufficient for the overall needs of the system 10. Additionally, units 42 may include isolation valves for removing the units from operation for service, replacement and the like.

The exhaust manifold 92 of the mid-temperature units 42 is connected by intermediate line 94 with a high-temperature intake manifold 96 having inlets communicating with the air conditioning units 44*a*, 44*b*, 44*c*, 44*d* and bypass valve 98. The outlet lines of the air conditioning units include temperature control valves 100 communicating in parallel with the exit line of valve 98 with an air conditioning exhaust manifold 102. In a conventional manner, the valves 100 are individually effective to maintain desired temperature conditions in the air conditioning units. The bypass valve 96 may be stepped or continuous varied by appropriate controls to maintain volumetric flow conditions in the secondary loop 22 sufficient for the overall needs of the system 10. Additionally, units 44 may include isolation valves for removing the units from operation for service, replacement and the like.

The exhaust manifold 102 is connected by line 104 to the inlet of a three-way defrost valve 110. One outlet line from the valve 110 is fluidly connected between check valve 60 and supply pump 70. The other outlet line from defrost valve 110 is fluidly connected between check valve 62 and circulation pump 112 that has an outlet connected with the inlet line 50 to the heat exchanger 32. A further isolation circuit 120, illustrated by the dashed lines, may be included.

It will thus be appreciated that the three sets of cooling loads are serially connected in the secondary loop 22, with parallel flow across the individual units in each stage. Such arrangement avoids the need for individual fluid connections with each stage, thereby reducing equipment, installation and refrigerant costs. Further, by operating the secondary loop in the liquid phase, numerous non-chlorinated, lower cost refrigerants may be employed. In particular, R-134a, while compatible with direct expansion systems is surprisingly effective in the fluid stages of the present invention providing an operational range from about −40° F. to +80° F. Other refrigeration fluids suitable for the secondary system include: glycol solutions, propylene glycol, ethylene glycol, brines, inorganic salt solutions, potassium solutions, potassium formiate, silicone plymers, synthetic organic fluids, eutectic solutions, organic salt solutions, citrus terpenes, hydrofluouroethers, hydrocarbons, chlorine compounds, methanes, ethanes, butane, propanes, pentanes, alcohols, diphenyl oxide, biphenyl oxide, aryl ethers, terphenyls, azeotropic blends, diphenylethane, alkylated aromatics, methyl formate, polydimethylsiloxane, cyclic organic compounds, zerotropic blends, methyl amine, ethyl amine, ammonia, carbon dioxide, hydrogen, helium, water, neon, nitrogen, oxygen, argon, nitrous oxide, sulfur dioxide, vinyl chloride, propylene, R400, R401A, R402B, R401C, R402A, R402B, R403A, R403B, R404A, R405A, R406A, R407A, R407B, R407C, R407D, R408A, R409A, R409B, R410A, R410B, R410A, R411B, R412A, R500, R502, R503, R504, R505, R506, R507A, R508A, R508B, R509A, R600A, R1150, R11, R113, R114, R12, RR22 R13, R116, R124, R124A, R125, R143A, R152A, R170, R610, R611, sulfur compounds, R12B1, R12B2, R13B1, R14, R22B1, R23, R32, R41, R114, R1132A, R1141, R1150, R1270, fluorocarbons, carbon dioxide, solutions of water, and combinations of the above fluids.

While not heretofore utilized in liquid phase, the present invention has determined that R-134a as a secondary coolant provides cost effective refrigeration, reduces coolant requirements, reduces power requirements, and significantly reduces adverse environmental impact in contrast with prevailing direct expansion and/or primary/secondary fluid approaches incorporating current secondary fluids such as 40% glycol, citrus terpine and HFE.

In liquid phase, R-134a has a specific heat of about 0.3 BTU/lb-F0, less than glycol and comparable to citrus terpine and HFE. The refrigerant has a substantially lower viscosity than the others resulting in significantly lower power and pumping requirements for circulation, particularly with respect to glycol at lower temperatures. Thermal conductivity is also within a satisfactory range for conventional heat exchanger design.

Operation of the Secondary Fluid Cooling System

With the primary system operating, the pumps 70 and 112 are started to circulate the secondary refrigerant in the secondary loop 22. The capacity of the secondary loop 22 will be dependent on the cooling loads for the individual stages and the capacity of the evaporator 32. Generally the entry temperatures for the secondary refrigerant are −40 F. to 0 F. for the freezer stage, +1 F. to +30 F. for the refrigeration stage, and +34 F. to +50 F. for the air conditioning stage. Passing through the first stage, the secondary refrigerant will experience a temperature rise based on the demand thereat, however, the entrance temperature and flow at the second stage for handling the refrigeration requirements in the refrigeration units. Similarly, the conditions presented to the air conditioning units will be sufficient to handle the load requirements for this stage.

Operation of the Defrost Cycle

From time to time, the cooling coils at the units may experience a frost or ice buildup limiting the cooling performance of the units. The secondary cooling system of the present invention may be quickly reconfigured to initiate a defrost cycle therefor. Such a cycle may be initiated by switching the position of the defrost valve 110 to the defrost position routing the fluid from line 104 to line 113. This results in plural flow paths. First, circulation of the fluid will be maintained between the reservoir 54 and the evaporator 32 by pump 112 thereby maintaining a supply of cooled refrigerant for immediate use after the defrost cycle. Second, a loop will be established bypassing the evaporator 32 and reservoir such that the temperature rise in the secondary refrigerant experienced at the air conditioning stage will circulate through the freezer and refrigerator coils thereby defrosting and deicing the associated units. Upon completion of the defrost cycle, the valve 110 is reversed and refrigerated fluid is immediately circulated in the secondary loop for quickly restoring refrigerated operating conditions.

Figure 4:
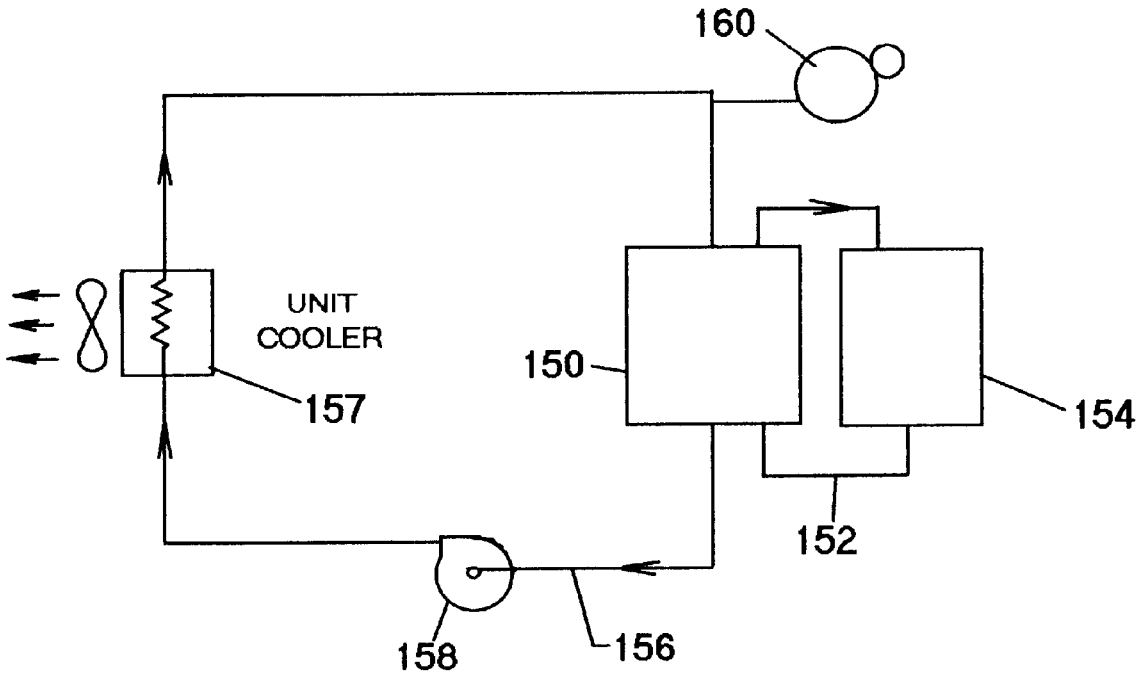
FIG. 4 is a schematic drawing of another embodiment of the secondary cooling system.

Referring to FIG. 4, the foregoing serial secondary system may obviously also be deployed for temperature control of a single zone. Therein, a secondary chiller 150 is connected with a direct expansion primary line 152, employing a direct expansion refrigerant such as R-404a at a primary condenser 154, and a secondary line 156 connected with an air flow unit cooler 157. The secondary coolant, R-134a, is circulated by pump 158. An expansion tank 160 is tapped to the secondary line 156.

Figure 2:
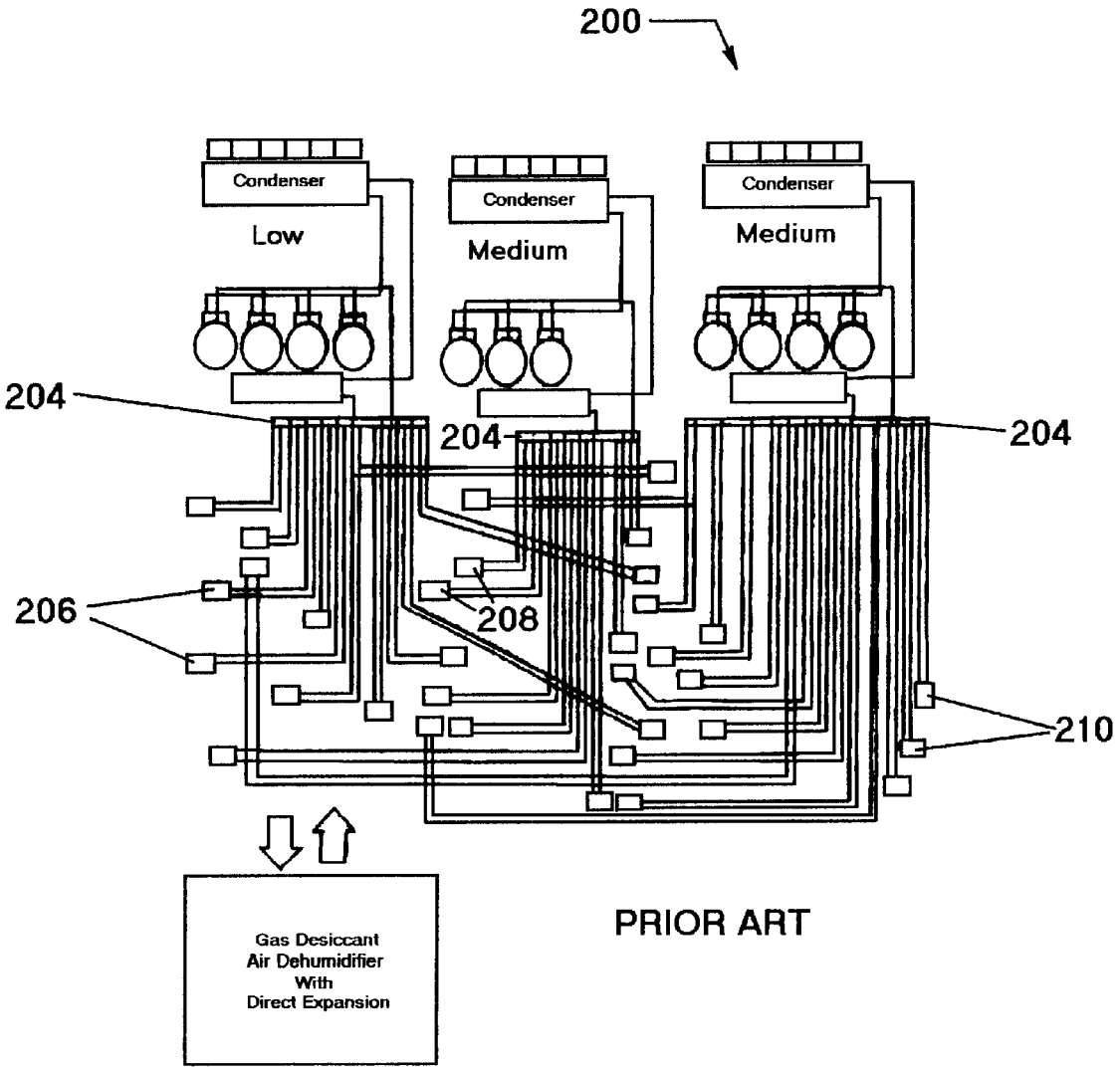
FIG. 2 is a schematic diagram of a conventional direct expansion cooling system with parallel compressor racks.
Figure 3:
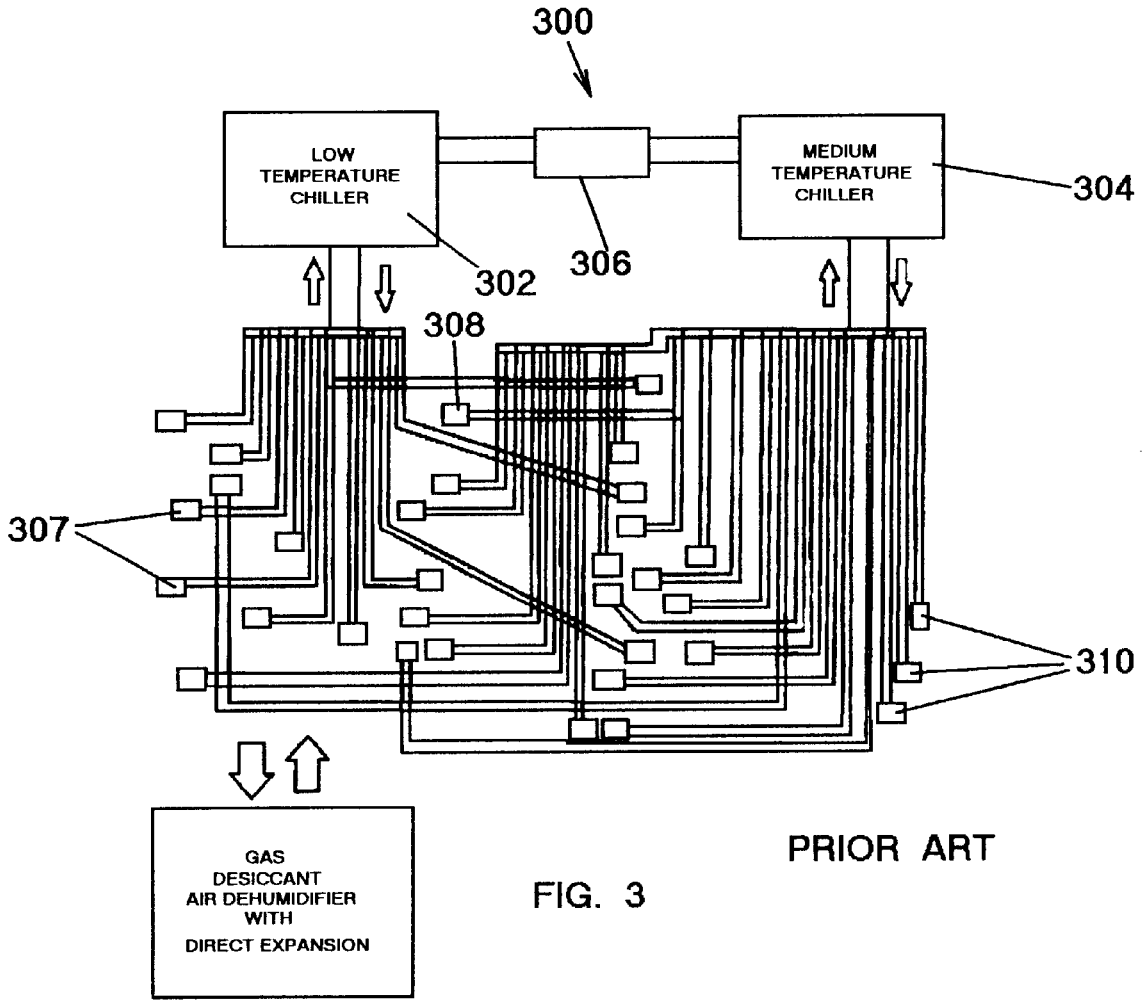
PRIOR ART FIG. 3
FIG. 3 is a schematic diagram of a conventional cooling system with parallel secondary cooling.

By way of contrast, a conventional supermarket parallel flow refrigeration system 200 is shown in FIG. 2. Therein, the refrigerant, typically R-404a is directed from plural condensers 202 to manifolds 204 for parallel routing to low temperature zones 206, medium temperature zones 208 and high temperature zones 210. In FIG. 3, there is illustrated a conventional secondary refrigerant system 300 wherein chillers 302 and 304 connected to direct expansion primary system 306 deliver the secondary coolant through parallel routing to low temperature zones 307, medium temperature zones 308 and high temperature zones 310.

Total Environmental Warming Impact (TEWI)

One of the significant indices used by regulatory agencies such as the United States Environmental Protection Agency (EPA) in assessing the environmental impact of refrigeration systems is the Total Environmental Warming Index. This index reflects both the effects of refrigeration system and refrigerants and the power factors in establishing a base line comparison.

Currently the TEWI index is set forth as follows:

$$TEWI=LR*RW*GWP+F*P*EL$$

(refr. cont) (pwr cont.)

wherein:

LR is the percentage leak rate from refrigerant lines, a function of line length, RW is the weight of refrigerant charge, GWP is a prescribed number for the global warming potential of the refrigerant, F is factor of carbon dioxide equivalency P is the power consumption per year, kwh/yr, EL is the equipment life.

The surprising effect of employing R-134a as a liquid secondary refrigerant is exemplified by comparing the TEWI for the system shown in FIG. 1, the system shown in FIG. 2 using R-404a as a direct expansion parallel flow system, and the system shown in FIG. 3 using R-404a as a primary direct expansion refrigerant and R-134a as a liquid secondary coolant. The comparison is on the basis of comparable location and cooling loads, demonstrated power consumption, leakage rate based on refrigerant line length, a fifteen year equipment life and 4000 hours of operation. R404a has a GWP of 3260 and R-134a a GWP of 1300. FIG. 1 had half the length and accordingly a leakage rate of 0.10 as compared to the accepted leakage rate of System 2. System 1 required 200 lb. Of R404a and 800 lb. of R-134a, System 2 required 2800 lb. of R-404a, and System 3 required 200 lb. of R-404a and 2800 lb. of R-134a.

For System 2, a TEWI of 29.2E+0.5 was calculated with a refrigerant contribution of 18.3E+05; for System 3, a TEWI of 18.5E+05 and a refrigerant contribution of 8.58E+05; and for System 1 a TEWI 11.7E+05 and a refrigeration contribution of 1.69E+05.

Accordingly, System 1 using a series liquid R-134a system has 40% of the TEWI of System 2 and a refrigerant contribution 9% of System 2. System 3 using parallel liquid R-134a has 64% of the TEWI of System 2 and a refrigerant contribution of 47% of System 2. Moreover, the foregoing advantages of System 1 were achieved surprisingly with about 60% of System 2 installation costs, and a slightly lower power consumption, 168.6 kw vs. 184.3 kw for System 2.

The above description is intended to be illustrative of the preferred embodiment, and modifications and improvements thereto will become apparent to those in the art. Accordingly, the scope of the invention should be construed solely in accordance with the appended claims.

What is claimed is:

1. A refrigeration system, comprising: a primary refrigeration system operating in a primary loop and carrying a primary refrigerant; a secondary refrigeration system operating in a secondary loop solely in liquid phase in a temperature range of about −40° F. to +80° F. and carrying as a secondary refrigerant liquid R-134a; and heat transfer means for transferring heat from said secondary loop to said primary loop.

2. The refrigeration system as recited in claim 1 herein said secondary loop includes an in-line coolant reservoir downstream of said heat transfer means for maintaining a storage supply.

3. The refrigeration system as recited in claim 2 including a bypass line interposed in said secondary loop for bypassing said heat exchange means and said reservoir, and valve means for selectively opening and closing said bypass line.

4. A method of transferring heat, comprising the steps of: providing a first heat sink; providing a first heat source; transferring heat between said first heat source and said first heat sink using a direct expansion refrigerant; providing a second heat sink; and transferring heat between said first heat sink and said second heat sink using refrigerant R-134a solely in the liquid phase in a temperature range of about −40° F. to +80° F.

5. In a refrigeration system having a primary refrigeration system operating in a primary loop and carrying a primary refrigerant thermally coupled at a first heat exchanger; a secondary refrigeration system comprising: a secondary loop thermally coupled to said first heat exchanger, said secondary loop operating solely in liquid phase in a temperature range of about −40° F. to +80° F. and carrying as a secondary refrigerant liquid R-134a; and liquid pump means in said secondary loop for circulating said secondary refrigerant in said liquid phase, wherein said primary loop and said first heat exchanger operate under conditions maintaining said secondary refrigerant in said liquid phase.

* * * * *